US009087663B2

(12) United States Patent
Los

(10) Patent No.: US 9,087,663 B2
(45) Date of Patent: Jul. 21, 2015

(54) KEYPAD APPARATUS FOR USE WITH ELECTRONIC DEVICES AND RELATED METHODS

(71) Applicant: Oleg Los, Buffalo Grove, IL (US)

(72) Inventor: Oleg Los, Buffalo Grove, IL (US)

(73) Assignee: BlackBerry Limited, Waterloo, Ontario (CA)

( * ) Notice: Subject to any disclaimer, the term of this patent is extended or adjusted under 35 U.S.C. 154(b) by 280 days.

(21) Appl. No.: 13/622,831

(22) Filed: Sep. 19, 2012

(65) Prior Publication Data

US 2014/0076704 A1 Mar. 20, 2014

(51) Int. Cl.
*H01H 1/10* (2006.01)
*H01H 13/807* (2006.01)

(52) U.S. Cl.
CPC ..... *H01H 13/807* (2013.01); *H01H 2205/006* (2013.01); *H01H 2207/026* (2013.01); *H01H 2215/01* (2013.01); *H01H 2215/012* (2013.01); *H01H 2223/014* (2013.01); *H01H 2225/028* (2013.01)

(58) Field of Classification Search
CPC ..... H01H 13/70; H01H 25/00; H01H 25/04; H01H 9/26; H01H 13/72; H01H 13/76; H01H 1/10; H03K 17/975
USPC ..... 200/343, 5 A, 5 R, 512, 513, 600, 341
See application file for complete search history.

(56) References Cited

U.S. PATENT DOCUMENTS

| | | | | |
|---|---|---|---|---|
| 4,314,116 | A * | 2/1982 | Gordon | 200/5 A |
| 4,687,200 | A | 8/1987 | Shirai | |
| 4,892,981 | A | 1/1990 | Soloway et al. | |
| 6,100,484 | A * | 8/2000 | Houze et al. | 200/512 |
| 6,148,183 | A * | 11/2000 | Higdon et al. | 455/575.1 |
| 7,164,091 | B2 | 1/2007 | Lu | |
| 7,383,066 | B2 | 6/2008 | Park | |
| 7,576,291 | B2 | 8/2009 | Tseng et al. | |
| 8,030,584 | B2 | 10/2011 | Lee | |
| 8,089,776 | B2 | 1/2012 | Kjerrman et al. | |
| 2009/0065342 | A1 * | 3/2009 | Yoon et al. | 200/5 A |
| 2011/0114463 | A1 | 5/2011 | Lee | |
| 2011/0255260 | A1 * | 10/2011 | Weber et al. | 361/807 |

OTHER PUBLICATIONS

LPKF Laser and Electronics, "3-Dimensional Circuitry Laser Direct Structuring Technology (LPKF-LDS) for Moulded Interconnect Devices," Brochure, 2010, 12 pages.
European Patent Office, "Office Communication," issued in connection with European application serial No. 12 184 954.1, issued Feb. 1, 2013, 2 pages.

* cited by examiner

*Primary Examiner* — Edwin A. Leon
*Assistant Examiner* — Anthony R. Jimenez
(74) *Attorney, Agent, or Firm* — Fish & Richardson P.C.

(57) ABSTRACT

A keypad apparatus and related methods are disclosed herein. An example keypad apparatus includes an electrical switch and a carrier composed of a plastic resin. The carrier has conductive traces printed thereon to couple the electrical switch to a circuit board via interference.

12 Claims, 11 Drawing Sheets

KEYPAD APPARATUS FOR USE WITH ELECTRONIC DEVICES AND RELATED METHODS

FIELD OF DISCLOSURE

The present disclosure relates to electronic devices, including but not limited to, key apparatus for use with electronic devices and related methods.

BACKGROUND

Electronic devices, including portable electronic devices, have gained widespread use and may provide a variety of functions including, for example, telephonic, electronic messaging, and other personal information manager (PIM) application functions. Portable electronic devices include, for example, several types of mobile stations such as simple cellular telephones, smart telephones, wireless personal digital assistants (PDAs), and laptop computers with wireless 802.11 or Bluetooth capabilities.

Portable electronic devices such as PDAs or smart telephones are generally intended for handheld use and ease of portability. With continued demand for decreased size of portable electronic devices, electronic devices continue to decrease in size. Thus, smaller devices are generally desirable for portability. Often these portable electronic devices include physical side keys (e.g., depressible keys, plastic keys, etc.) to input information. However, physical keys typically employ an electrical switch assembly that is soldered to a circuit board. As a result, coupling an electrical switch assembly to a circuit board typically results in an electronic device having a larger dimensional envelope or size.

DETAILED DESCRIPTION

Figure 1:
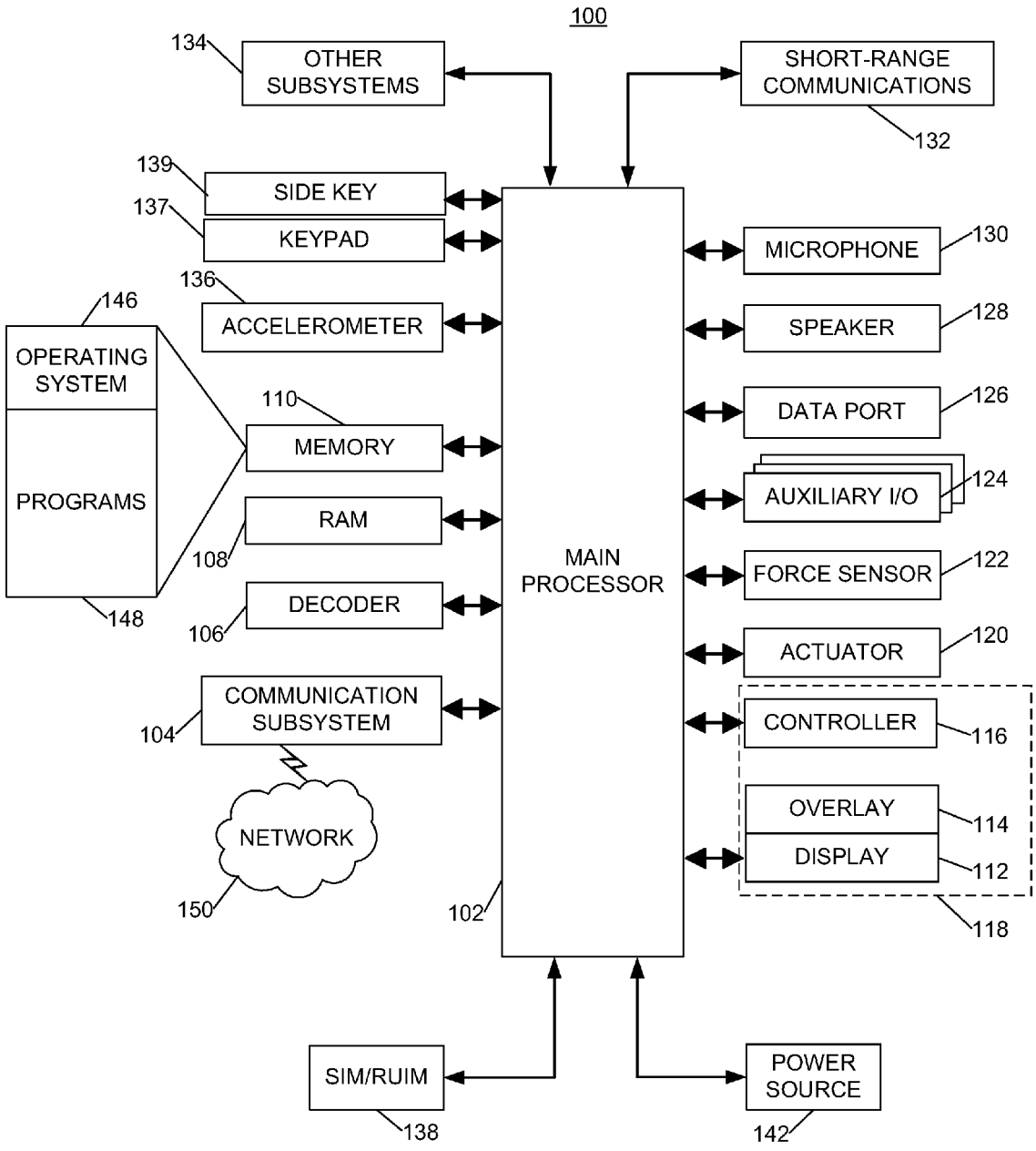
FIG. 1 is a block diagram of an example portable electronic device in accordance with the teachings disclosed herein.

Example keypad apparatus and methods disclosed herein reduce an overall dimensional envelope of an electronic apparatus. To generate an electrical signal when a key of the keypad apparatus is activated, the keypad apparatus employs an electrical switch. An example electrical switch described herein may include one or more collapsible dome switches associated with, or corresponding to, a depressible key of a keypad and electrical or conductive contacts of a circuit board. For example, an electrical switch apparatus disclosed herein is electrically coupled to a circuit board to generate an electrical signal when a key associated with the electrical switch is activated.

More specifically, the example keypad apparatus disclosed herein may employ a carrier to electrically couple the example electrical switch to the circuit board. In particular, a dome switch collapses toward a conductive contact formed or printed on the carrier. In turn, the conductive contact of the electrical switch is electrically coupled to the circuit board via a plurality of conductive traces formed on one or more surfaces of the carrier between the conductive contact and a conductive element of a circuit board (e.g., an integrated circuit). In some instances, the example carriers are electrically coupled to a side surface (e.g., plated with conductive material) of the circuit board substantially perpendicular to a main surface of the circuit board (e.g., a surface generally parallel relative to a display of an electronic device). In some examples, the example carriers disclosed herein employ flexible fingers, arms or structures that engage a side surface of a circuit board. For example, the flexible fingers may engage respective ones of machined and electrically plated through holes or slots of the circuit board to electrically couple the carrier to the circuit board. For example, the conductive traces may be printed or provided on the flexible fingers which engage the plated slots to electrically couple the dome switch to the circuit board via the carrier. In some examples, a rear or vertical surface of the carrier includes a conductive trace or wire that engages the side surface of the circuit board to electrically couple the conductive contact to the circuit board.

Additionally or alternatively, the carrier mechanically couples the dome-switch to the circuit board via, for example, frictional interference and/or interference fit. For example, the example carriers disclosed herein may employ flexible fingers that provide a spring bias that produces a force normal to the point of contact between the fingers and the circuit board when the carrier is coupled to the circuit board. As a result, the example carriers disclosed herein retain the carrier in engagement (e.g., in frictional engagement) with the circuit board in a relatively fixed position relative to the circuit board without the use of fasteners (e.g., chemical fasteners, mechanical fasteners, solder, etc.). In this manner, for example, the example keypad apparatus disclosed herein reduce cost associated with soldering the carrier to the circuit board. In some examples, the carrier may be at least partially disposed in a recess or cavity of a circuit board.

An example carrier disclosed herein is composed of plastic and the conductive contact and/or the plurality of conductive traces are printed on the carrier via, for example, Laser Direct Structuring manufacturing process or techniques.

For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

The disclosure generally relates to an electronic device, such as a portable electronic device as described herein. Examples of electronic devices include mobile, or handheld, wireless communication devices such as pagers, cellular phones, cellular smart-phones, wireless organizers, personal digital assistants, wirelessly enabled notebook computers, tablet computers, mobile internet devices, electronic navigation devices, and so forth. The electronic device may be a portable electronic device without wireless communication capabilities, such as a handheld electronic game, digital photograph album, digital camera, media player, e-book reader, and so forth.

A block diagram of an example portable electronic device 100 is shown in FIG. 1. The electronic device 100 includes multiple components, such as a processor 102 that controls the overall operation of the electronic device 100. Communication functions, including data and voice communications, are performed through a communication subsystem 104. Data received by the electronic device 100 is decompressed and decrypted by a decoder 106. The communication subsystem 104 receives messages from and sends messages to a wireless network 150. The wireless network 150 may be any type of wireless network, including, but not limited to, data wireless networks, voice wireless networks, and networks that support both voice and data communications. A power source 142, such as one or more rechargeable batteries or a port to an external power supply, powers the electronic device 100.

The processor 102 interacts with other components, such as a Random Access Memory (RAM) 108, memory 110, a touch-sensitive display 118, one or more actuators 120, one or more force sensors 122, an auxiliary input/output (I/O) subsystem 124, a data port 126, a speaker 128, a microphone 130, short-range communications 132 and other device subsystems 134, a keypad 137, a side key 139, etc. The touch-sensitive display 118 includes a display 112 and an overlay 114 that are coupled to at least one controller 116 that is utilized to interact with the processor 102. Input via a graphical user interface is provided via the touch-sensitive display 118, the keypad apparatus 137 and/or the side key 139. Information, such as text, characters, symbols, images, icons, and other items may be displayed or rendered on the touch-sensitive display 118 via the processor 102. The processor 102 may also interact with an accelerometer 136 that may be utilized to detect direction of gravitational forces or gravity-induced reaction forces.

To identify a subscriber for network access, the electronic device 100 may utilize a Subscriber Identity Module or a Removable User Identity Module (SIM/RUIM) card 138 for communication with a network, such as the wireless network 150. Alternatively, user identification information may be programmed into memory 110.

The electronic device 100 includes an operating system 146 and software programs, applications, or components 148 that are executed by the processor 102 and are typically stored in a persistent, updatable store such as the memory 110. Additional applications or programs may be loaded onto the portable electronic device 100 through the wireless network 150, the auxiliary (I/O) subsystem 124, the data port 126, the short-range communications subsystem 132, or any other device subsystems 134.

A received signal such as a text message, an e-mail message, or web page download is processed by the communication subsystem 104 and input to the processor 102. The processor 102 processes the received signal for output to the display 112 and/or to the auxiliary (I/O) subsystem 124. A subscriber may generate data items, for example e-mail messages, which may be transmitted over the wireless network 150 through the communication subsystem 104. For voice communications, the overall operation of the electronic device 100 is similar. The speaker 128 outputs audible information converted from electrical signals, and the microphone 130 converts audible information into electrical signals for processing.

The touch-sensitive display 118 may be any suitable touch-sensitive display, such as a capacitive, resistive, infrared, surface acoustic wave (SAW) touch-sensitive display, strain gauge, optical imaging, dispersive signal technology, acoustic pulse recognition, and so forth. A capacitive touch-sensitive display includes one or more capacitive touch sensors or overlay 114. The capacitive touch sensors may comprise any suitable material, such as indium tin oxide (ITO). In other examples, the electronic device 100 may include a non-touch sensitive display instead of, and/or in addition to, the touch-sensitive display 118.

Figure 2:
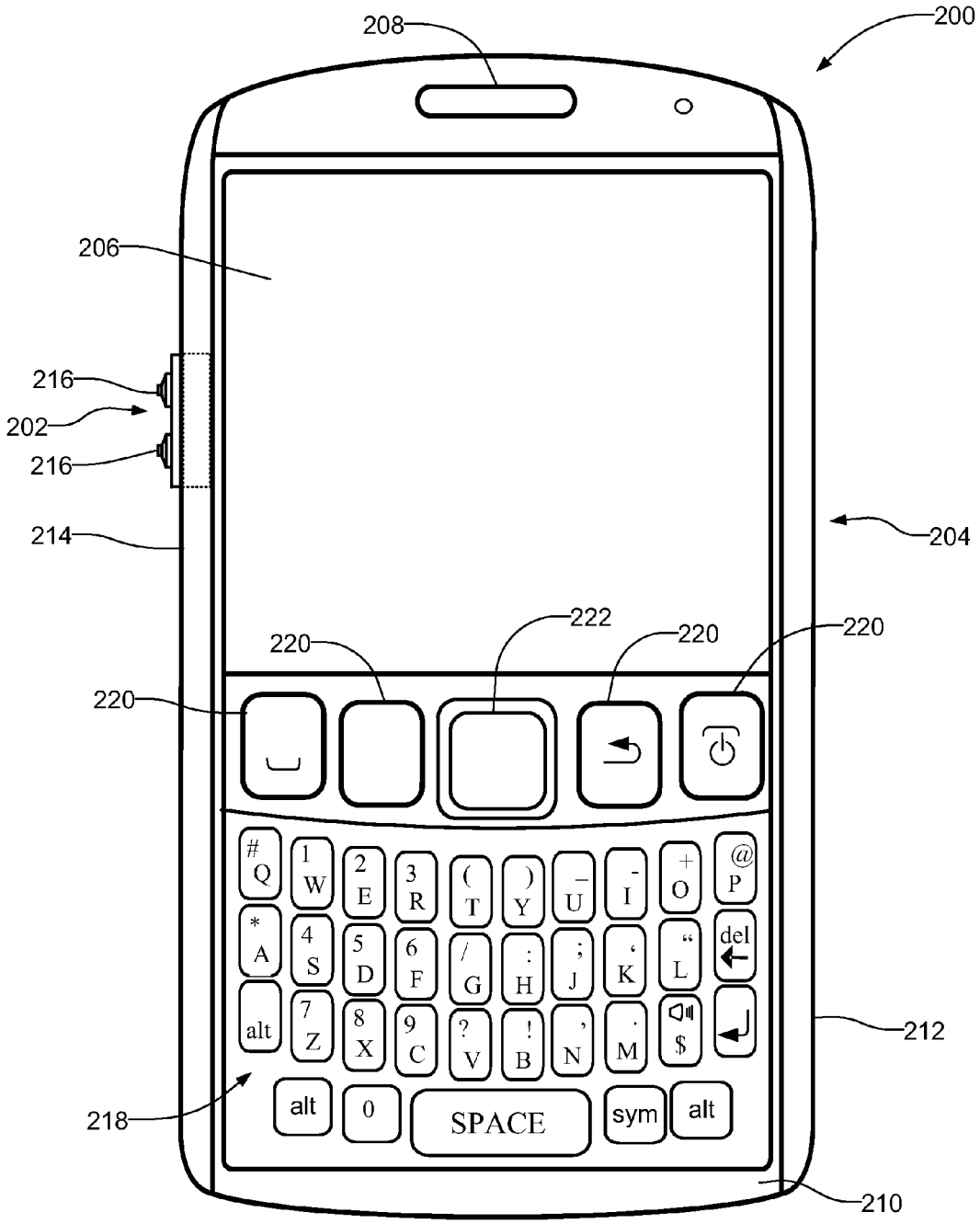
FIG. 2 is an example portable electronic device of FIG. 1 implemented with an example keypad apparatus in accordance with the teachings disclosed herein.

FIG. 2 is a plan view of a portable electronic device 200 having a keypad apparatus or assembly 202 in accordance with the teachings disclosed herein. In the example of FIG. 2, the portable electronic device 200 is a handheld or portable communication device (e.g., a mobile phone). As mentioned above, the electronic device 200 may be a data and/or voice-enabled handheld device that may be used to send and receive a message, a voice communication, a textual entry, etc. Referring to FIG. 2, the electronic device 200 includes a housing 204 that encloses electronic or mobile components such as, for example, the electronic components described above in connection with FIG. 1. For example, the housing 204 encloses the keypad apparatus 202, a display 206, a speaker 208, a microphone, an auxiliary I/O, a data port, etc. The housing 204 may include a front cover or lid 210 that couples to a frame or base 212 to capture the electronic components within the housing 204. The housing 204 of the illustrated example can be held in one hand by a user of the electronic device 200 during data (e.g., text) and/or voice communications.

In the example of FIG. 2, the keypad apparatus 202 disclosed herein is positioned on a side surface 214 of the electronic device 200. However, in some examples, the keypad apparatus 202 may be positioned on another side surface and/or on multiple side surfaces of the electronic device 200. (e.g., a top side surface, a bottom side surface, side surfaces, etc.) The keypad apparatus 202 may include one or more buttons or keys 216 that may be employed to input various commands to the electronic device. For example, the keys 216 may be used to increase or decrease a volume of the electronic device 200. In some examples, the keys 216 may be employed to zoom in and/or zoom out when the electronic device 200 is in a camera mode. Additionally, the display 206 (e.g., a touch-screen display) may provide a keypad 218 to provide a user input and accommodate textual inputs to the electronic device 200. The keypad 218 enables character inputs including alphabetical and/or numeric entries to allow text and/or numeric entry for various functions. For example, the keypad 218 may be a QWERTY style keypad, a SureType keypad, or any other suitable physical keypad(s). Alternatively, the keypad 218 may be a virtual keyboard that appears on a touch screen display (not shown). In this example, the electronic device 200 also includes function keys 220. For example, the function keys 220 may include an on/off button or call end button, a call send button, a menu button, an escape key, etc. The electronic device 200 may also include a track ball or trackpad 222 to input information and/or control commands.

A user interacts with the electronic device 200 via the keypad apparatus 202, the keypad 218, the function keys 220 and/or the trackpad 222 to choose commands, execute application programs, and perform other functions by selecting menu items or icons. In combination with the keypad apparatus 202, a user may interact with the electronic device 200 via the touch-sensitive display to choose commands, execute application programs, and perform other functions by selecting menu items or icons by contacting or touching the icon or image via the touch screen.

Figure 3:
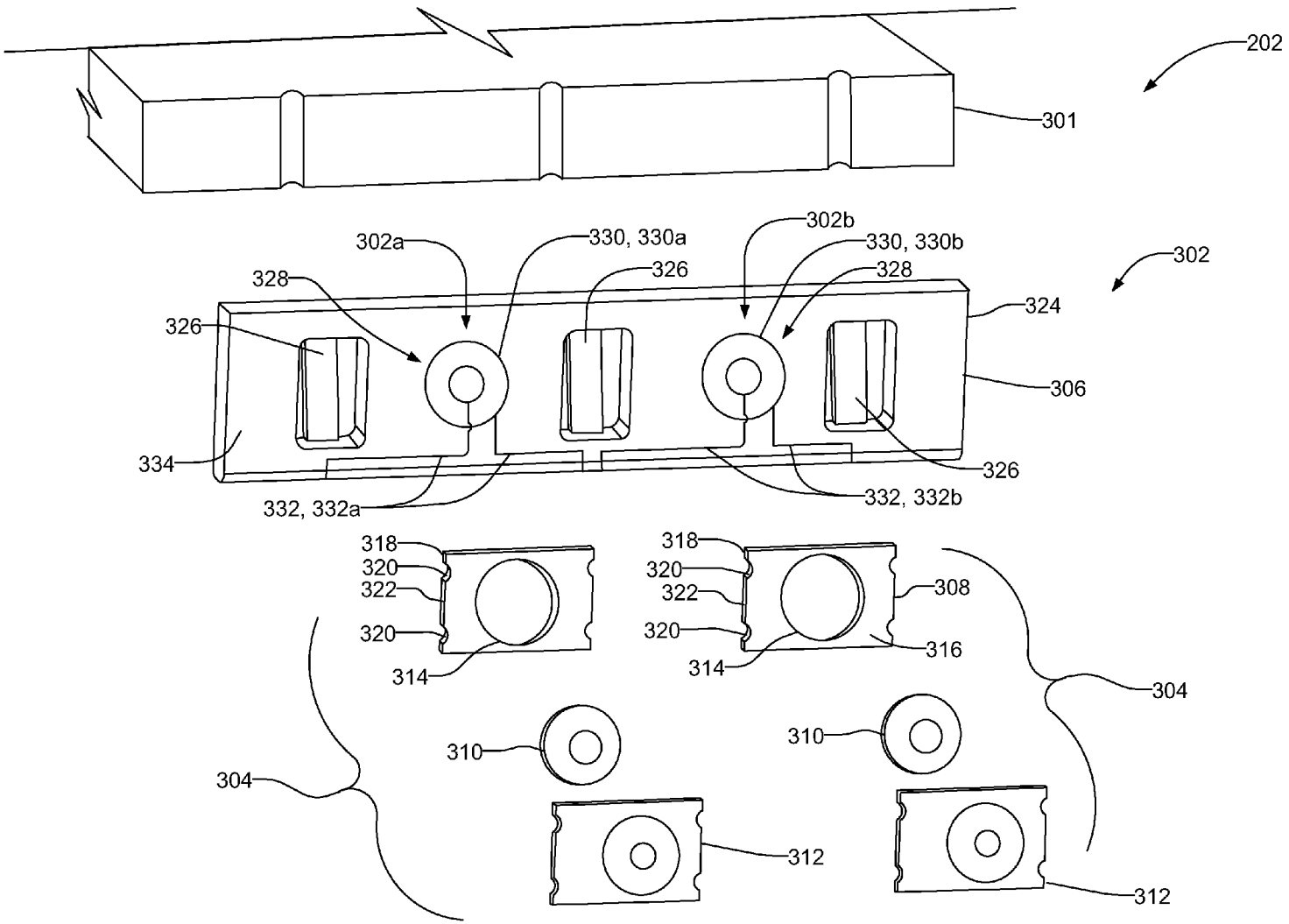
FIG. 3 is an exploded view of the example keypad apparatus of the electronic device of FIG. 2.

FIG. 3 illustrates an exploded view of an example electrical switch assembly 300 of the example keypad apparatus 202 of FIG. 2. The electrical switch assembly 300 is shown without the housing 204 of the electronic device 200. The electrical switch assembly 300 of the illustrated example defines an electrical switch to couple to a structure or circuit board 301 (e.g., a printed circuit board or integrated circuit board). More specifically, in this example, the electrical switch assembly 300 defines electrical switches 302*a* and 302*b* each associated with respective ones of the keys 216. However, in other examples, the electrical switch assembly 300 may include only one electrical switch or more than two electrical switches.

The electrical switch assembly 300 of the illustrated example includes a dome-switch assembly 304 coupled to a carrier 306. The dome-switch assembly 304 includes a housing 308, a dome 310 and a dome sheet 312. The housing 308 of the illustrated example includes an opening or aperture 314 extending between a first surface 316 of the housing 308 and a second surface 318 of the housing 308 opposite the first surface 316. The aperture 314 of the housing 308 is configured or sized to receive at least a portion of the dome 310. More specifically, at least a portion of the dome 310 is positioned in the aperture 314 when the dome-switch assembly 304 is coupled to the carrier 306. The dome 310 of FIG. 3 is a metal dome. The dome sheet 312 (e.g., a mylar film) retains the dome 310 in the aperture 314 of the housing 308. The dome sheet 312 is coupled or attached to a first surface 316 of the housing 308 via, for example, adhesive. The housing 308 of the illustrated example couples the dome 310 to the carrier 306. In the illustrated example, the dome-switch assembly 304 or the housing 308 is coupled or attached to the carrier 306 via, for example, solder. As shown, the housing 308 includes one or more recesses, apertures or slots 320 positioned or formed on a side surface 322 of the housing 308 to receive the solder to facilitate attachment or assembly of the housing 308 to the carrier 306. However, in other examples, the housing 308 may be attached to the carrier 306 via adhesive and/or any other suitable chemical fastener(s) and/or mechanical fastener(s).

The carrier 306 of the illustrated example comprises a body 324 having a plurality of flexible fingers or arms 326. The body 324 and the flexible fingers 326 provide a plurality of conductive trace patterns 328. More specifically, each of the trace patterns 328 defines a first portion or conductive contacts 330 (e.g., electrical contacts) and a second portion or conductive traces 332 (e.g., electrical traces). In particular, the conductive contacts 330 are formed or provided on a first surface 334 (e.g., a side surface) of the carrier 306 and interact with the dome 310. The conductive traces 332 couple the conductive contacts 330 to the circuit board 301. As shown in the example of FIG. 3, a first set of electrical contacts 330*a* is electrically coupled to the circuit board 301 via a first plurality of conductive traces 332*a* and a second set of electrical contacts 330*b* is electrically coupled to the circuit board 301 via a second plurality of conductive traces 332*b*. The first and second plurality of conductive traces 332*a* and 332*b* electrically isolate the first and second set of electrical contacts 330*a* and 330*b*, respectively.

The body 324 of the carrier 306 of the illustrated example is a unitary structure or body. The body 324, for example, is composed of a plastic material or plastic resin such as, for example, a resin or plastic capable of being used in a Laser Direct Structuring (LDS) process(es). For example, an LDS capable resin may include thermoplastic materials such as, for example, Polypropylene, Polyethylene terephthalate, Polysulfone, etc. The body 324 may be integrally formed via, for example, injection molding and/or any other suitable manufacturing process(es). However, in some examples, the carrier 306 or the body 324 may be formed as multiple pieces (e.g., two-piece body) that may be coupled together via chemical fasteners (e.g., adhesive), mechanical fasteners, plastic welding, etc.

In the illustrated example, after the body 324 is formed via an injection molding process, the electrical contacts 330 and/or the conductive traces 332 electrically coupling the electrical contacts 330 to the circuit board 301 may be formed or etched in the body 324 via, for example, LDS manufacturing process. Such a process enables injection molded plastic parts such as the body 324 to be selectively plated with discrete circuit pathways (i.e., the plurality of trace patterns 328). To this end, a laser basically etches, writes or prints a conductive trace pattern corresponding to the position of the conductive contacts 330 and/or the conductive traces 332 onto the body 324 after the body 324 is formed via injection molding. The body 324 having the printed pattern, contacts and/or traces is then immersed within a copper bath to provide the conductive contacts 330, the conductive traces 332 and/or the trace patterns 328.

Figure 4:
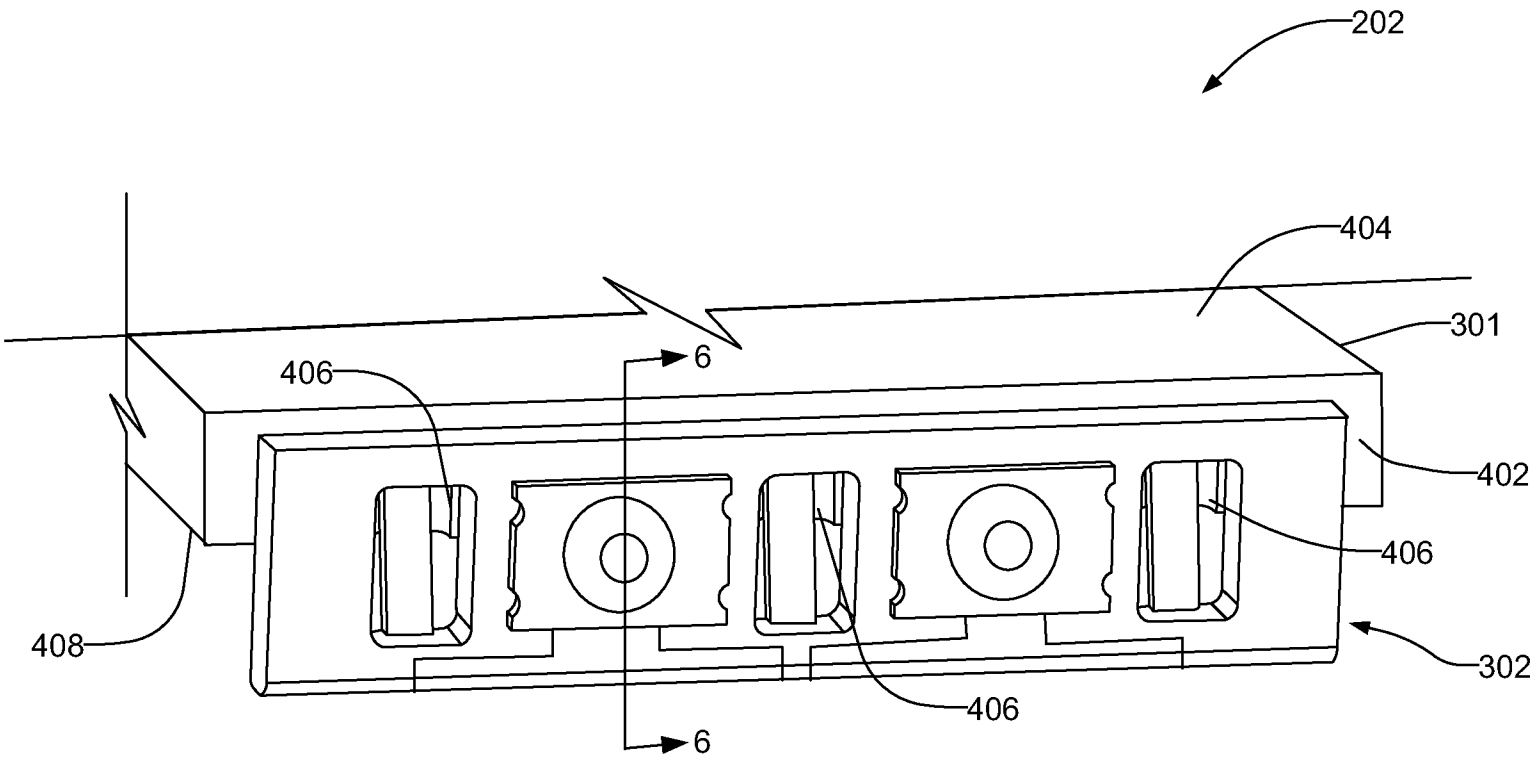
FIG. 4 is perspective view of the example keypad apparatus of FIG. 2 and FIG. 3.

FIG. 4 is a perspective view of the example electrical switch assembly 300 of FIG. 3 coupled to the circuit board 301. More specifically, the electrical switch assembly 300 is coupled to the circuit board 301 via frictional engagement or interference fit. In this manner, the switch assembly 300 may be coupled to the circuit board 301 without the use of fastener(s) (e.g., solder). However, in other examples, the electrical switch assembly 300 may be coupled to the circuit board 301 via, for example, solder.

In the illustrated example, the electrical switch assembly 300 is electrically coupled to a first or side surface 402 of the circuit board 301. As shown in FIG. 4, the side surface 402 of the circuit board 301 is substantially parallel relative to the side surface 214 of the housing 204 of FIG. 2. Thus, the side surface 402 of the circuit board 301 of the illustrated example is substantially perpendicular to the second surface 404 of the circuit board 301, which is substantially parallel or aligned with the display 206 of the electronic device 200 of FIG. 2. As shown in FIG. 4, the side surface 402 of the circuit board 301 has a surface area that is substantially less than a surface area of the second surface 404. To enable the electrical switch assembly 300 to be electrically coupled to the side surface 402 of the circuit board 301, the circuit board 301 includes one or more apertures or slots 406 (e.g., through holes) plated with an electrically conductive material (e.g., copper). As shown in FIG. 4, the plated slots 406 are exposed or accessible via the side surface 402 of the circuit board 301. Each of the plated slots 406 defines a longitudinal axis and each of the slots 406 extends between the second surface 404 and a third or bottom surface 408 of the circuit board 301. In some examples, the slots 406 partially extend between the second surface 404 and the bottom surface 408.

Figure 5A:
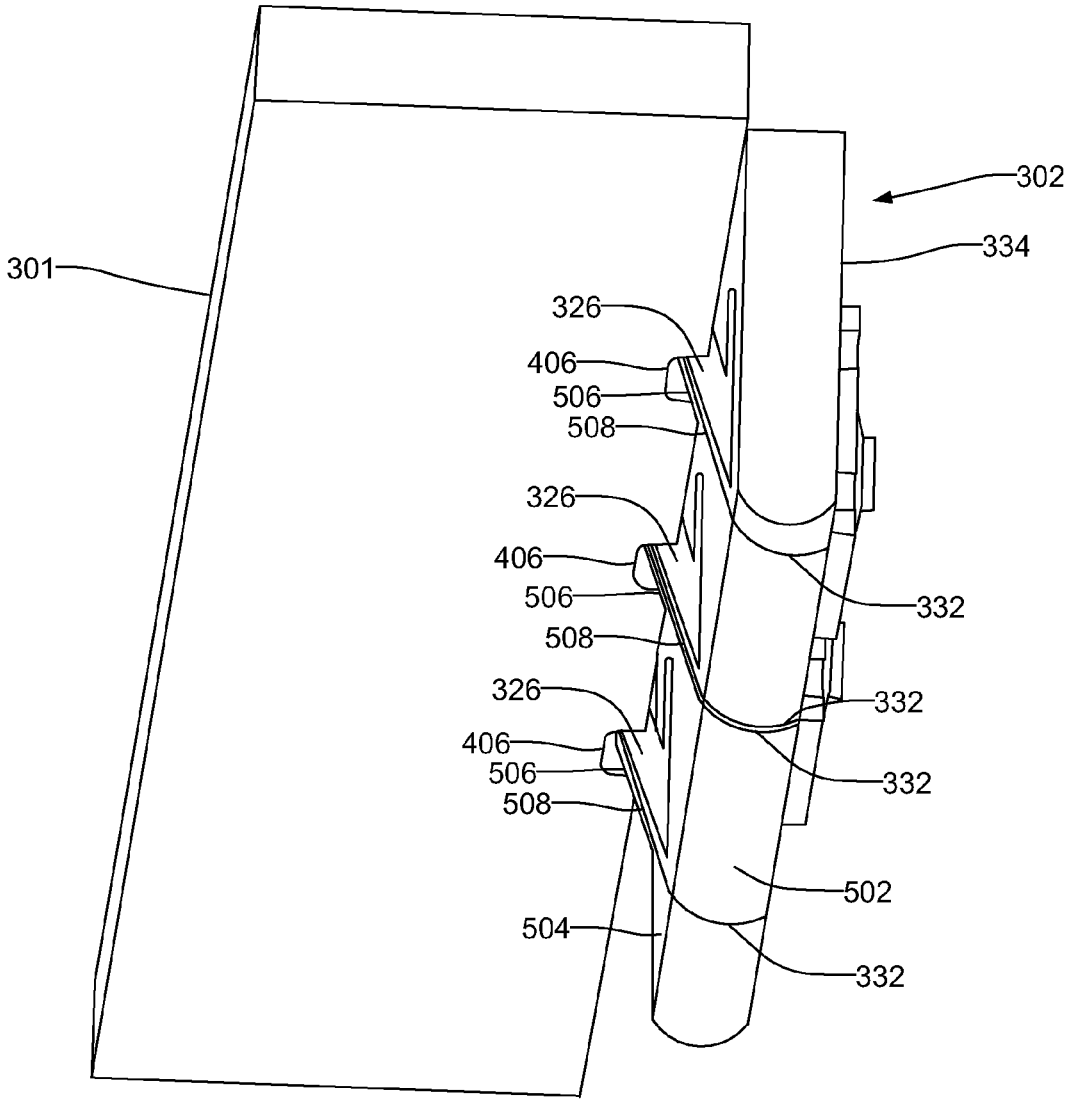
FIG. 5A is a plan view of the example keypad apparatus of FIGS. 2-4.

FIG. 5A is a perspective bottom view of the electrical switch assembly 300 coupled to the circuit board 301. FIG.

Figure 5B:
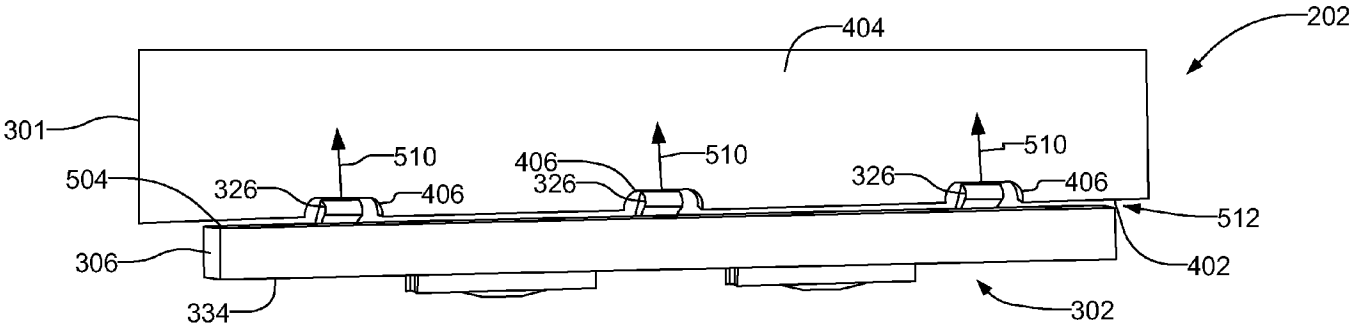
FIG. 5B is another perspective view of the example keypad apparatus of FIGS. 2-4 and 5A.

5B is a plan view of the example electrical switch assembly 300 coupled to the circuit board 301. Referring to FIG. 5A and FIG. 5B, to electrically couple the electrical contacts 330 to the circuit board 301, the conductive traces 332 extend from the electrical contacts 330 to the conductive plated slots 406 of the circuit board 301. More specifically, the conductive traces 332 extend from the first surface 334 of the carrier 306, an intermediate surface 502 (e.g., a curved bottom surface), a second surface 504 and along an outer surface 506 of the flexible flingers 326. Thus, as shown in the illustrated example, a portion 508 of the conductive traces 332 are printed, formed or provided on the outer surface 506 of the flexible fingers 326. The portion 508 of conductive traces 532 on the outer surface 506 of the flexible fingers 326 electrically engage the plated slots 406 of the circuit board 301 to electrically couple the electrical contacts 330 to the circuit board 301. In other words, the conductive traces 332 and/or the electrical contacts 330 can be positioned and/or formed on any and/or all of the surfaces of the carrier 306 including, for example, the flexible fingers 326. The conductive traces 332 may be configured on the carrier 306 in any pattern or surface to electrically couple the electrical contacts 330 and the plated slots 406 of the circuit board 301.

Additionally, the flexible fingers 326 of the carrier 306 of the illustrated example mechanically couple the carrier 306 to the circuit board 301 via frictional engagement or interference. The flexible fingers 326 provide a spring bias or force 510 to retain the carrier 306 engaged with the plated slots 406 of the circuit board 301. For example, each of the flexible fingers 326 provide a reactive force 510 in a direction normal to the longitudinal axes of the plated slots 406 and/or the side surface 402 of the circuit board 301. As clearly shown in FIG. 5B, the carrier 306 can be positioned adjacent the side surface 402 of the circuit board 301 with relatively small clearance or distance 512. As a result, the closer the flexible fingers 326 bend, flex and/or move toward the second side 504 of the carrier 306, the greater the force 510 the flexible fingers 326 impart to the plated slots 406 of the circuit board 301 to retain the carrier 306 coupled or positioned relative to the plated slots 406 and/or the circuit board 301. Thus, the flexible fingers 326 provide the force 510 to retain the carrier 306 coupled to the circuit board 301 when the electrical switch assembly 300 is positioned between the housing 204 of the electronic device 200 of FIG. 2 and the circuit board 301. Thus, the carrier 306 does not require solder, adhesive and/or other fasteners to couple to the circuit board 301. Instead, the flexible fingers 326 prevent the carrier 306 from moving or shifting laterally relative to and/or along the side surface 402 of the circuit board 301. Accordingly, because solder is not needed to couple the carrier 306 to the circuit board 301, the dimensional envelope of the electrical switch assembly 300 is significantly smaller. As a result, the electrical switch assembly 300 and/or carrier 306 enable the electronic device 200 to have a substantially smaller dimensional envelope or profile (e.g., a dimensional height). Additionally or alternatively, because chemical or mechanical fasteners are not needed to couple the electrical switch assembly 300 to the circuit board 301, the electrical switch assembly 300 significantly facilitates assembly of the electronic device 200 of FIG. 2.

Figure 6:
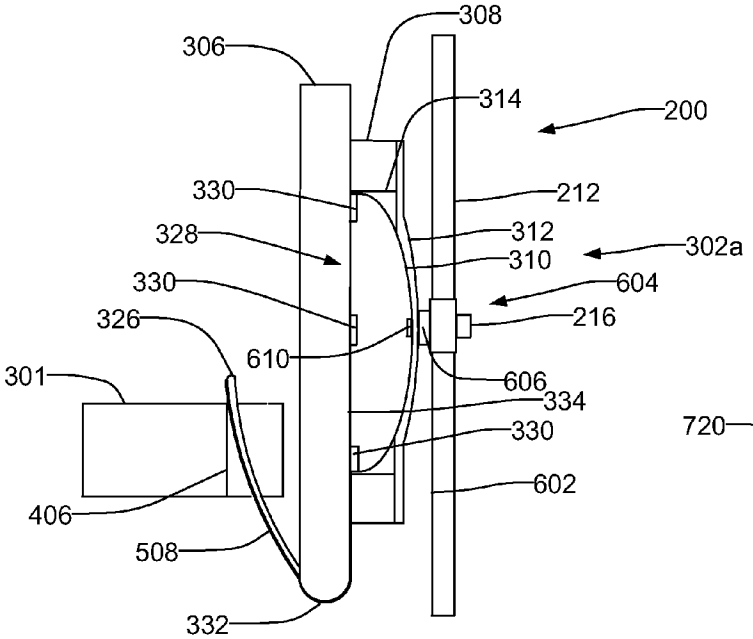
FIG. 6 is a cross-sectional view of the example keypad apparatus of FIGS. 2-4, 5A and 5B taken along line 6-6 of FIG. 4.

FIG. 6 is a cross-sectional side view of the example electrical switch assembly 302 of FIGS. 2-4, 5A and 5B taken along line 6-6 of FIG. 4. As shown in FIG. 6, the electrical switch assembly 300 is positioned between a side wall 602 of the housing 204 or base 212 of the electronic device 200 and the circuit board 301. The keypad apparatus 202 of the illustrated example includes an actuator assembly 604 positioned adjacent the electrical switch assembly 300. The actuator assembly 604 interacts with the electrical switch assembly 300 to generate an electrical signal when a user depresses the keys 216 associated or corresponding to the electrical switches 302*a* or 302*b*. The actuator assembly 604 of the illustrated example includes the key 216 (e.g., a button) and a plunger or actuator 606 positioned between the key 216 and the dome 310. The actuator 606 provides stiffness to hold the key 216 in position when a force is not exerted on the key 216 toward the dome 310. In this example, the key 216 at least partially extends from the housing 204 when the key 216 is not depressed as shown in FIG. 6.

The dome 310 is positioned adjacent the electrical elements 330 of the carrier 306 and is aligned relative to the conductive contacts 330 of the respective trace patterns 328. As shown, the dome 310 is positioned inside the aperture 314 of the housing 308 such that the dome 310 can engage the first surface 334 of the carrier 306. More specifically, the aperture 314 enables the dome 310 to engage the electrical contacts 330 when the dome 310 is deflected or collapsed. As shown, the dome sheet 312 retains the dome 310 in the aperture 314 of the housing 308.

In operation, the actuator 606 provides stiffness to hold the key 216 in position. Further, the dome-switch assemblies 304 are in a non-deflected or non-collapsed position when the key 216 is not pressed or actuated. A user can exert a force (e.g., a side force) on the key 216 to depress the key 216 associated with the electrical switch 302*a* with relative ease. The force required to press the key 216 is large enough that the person can feel a resistance to the pressure of their finger on the key 216. The electronic device 200 detects or senses a deflection or activation of the electrical switch when the key 216 is in a depressed position or actuated position relative to the base 212 to activate the electrical switch and generate an electrical signal.

For example, to activate the electrical switch 302*a*, a user depresses the key 216 associated with the electrical switch 302*a* to provide data input to the electronic device 200. In particular, the electrical switch 302*a* generates an output signal that is received by a processor (e.g., the processor 102) when the key 216 is depressed by a user. When a user presses the key 216, the actuator 606 moves toward the trace pattern 328 of the carrier 306. The actuator 606 presses against the dome 310 to cause the dome 310 to deflect, collapse, flex or bend toward the trace pattern 328 of the carrier 306. In turn, the dome 310 collapses toward the conductive contacts 330 of the trace pattern 328 such that a contact surface 610 of the dome 310 engages the conductive contacts 330 of the carrier 306, thereby closing an electrical circuit and generating an electrical signal that is received or detected by the processor 102. The dome 310 is configured to provide a dome-snap profile to provide a click (e.g., an audible sound) or snap feel tactility to a user.

To return the key 216 to the non-actuated or initial position in which the electrical switch is deactivated, a user releases the key 216. When the key 216 is released, the actuator 606 returns to its original position or state and releases the dome 310. The dome 310 also snaps back to its initial, original or dome shaped position. The dome 310 provides a tactile feedback (e.g., a force) to the user when the dome 310 snaps back to its original position. In particular, the dome 310 functions as a spring to push the actuator 606 back to the initial or non-activated position as shown in FIG. 6.

Although not shown, in other examples, the switch assembly 300 can be configured without use of the dome-switch assembly 304. For example, the actuator 606 may employ a conductive material or element to interact with the conductive contacts 330 of the carrier 306. For example, the actuator 606 may be biased away from the first surface 334 of the carrier 306 via a biasing element.

Figure 7:
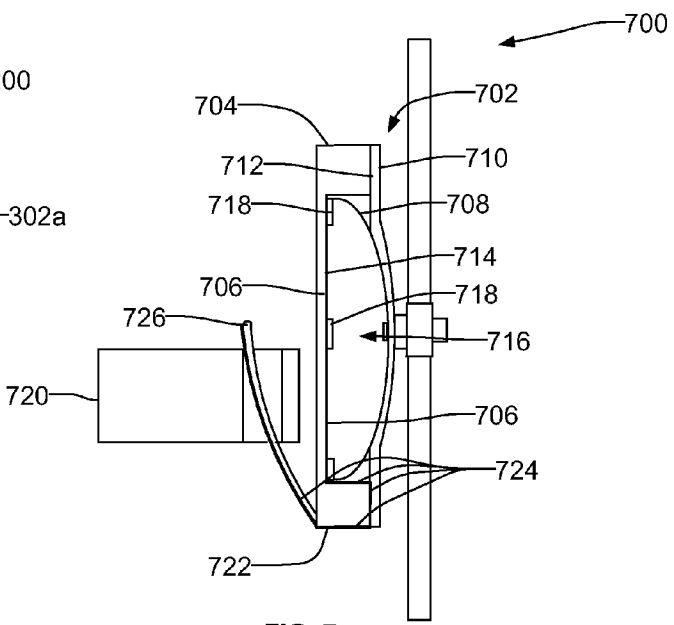
FIG. 7 is a cross-sectional view similar to FIG. 6, but illustrating another example keypad apparatus in accordance with the teachings disclosed herein.

FIG. 7 illustrates another example keypad apparatus 700 constructed in accordance with the teachings disclosed herein. Unlike the example keypad apparatus 202 of FIGS. 2-4, 5A, 5B and 6, an electrical switch assembly 702 of the example keypad apparatus 700 of FIG. 7 does not employ a housing (e.g., the housing 306 of the dome-switch assembly 304). Instead, a carrier 704 is formed with a recess or cavity 706 to receive at least a portion of a dome 708. A dome-sheet 710 is attached to a surface 712 of the carrier 704 to retain the dome 708 in the cavity 706. A surface or wall 714 defined by the cavity 706 includes a trace pattern 716. The trace patterns 716 include conductive contacts 718 that are routed to a circuit board 720 via conductive traces 722 formed on surface 724, the surface 714 and/or a flexible finger 726 of the carrier 704 in a manner similar to the trace patterns 328 of FIGS. 2-4, 5A, 5B and 6. The carrier 704 is formed via injection molding and the conductive contacts 718 and/or the traces 722 may be formed on the carrier 704 via, for example, LDS manufacturing process. As shown, because the carrier 704 may be formed via injection molding, the example carrier 704 is formed with the cavity 706 sized or configured to receive the dome 708.

Figure 8:
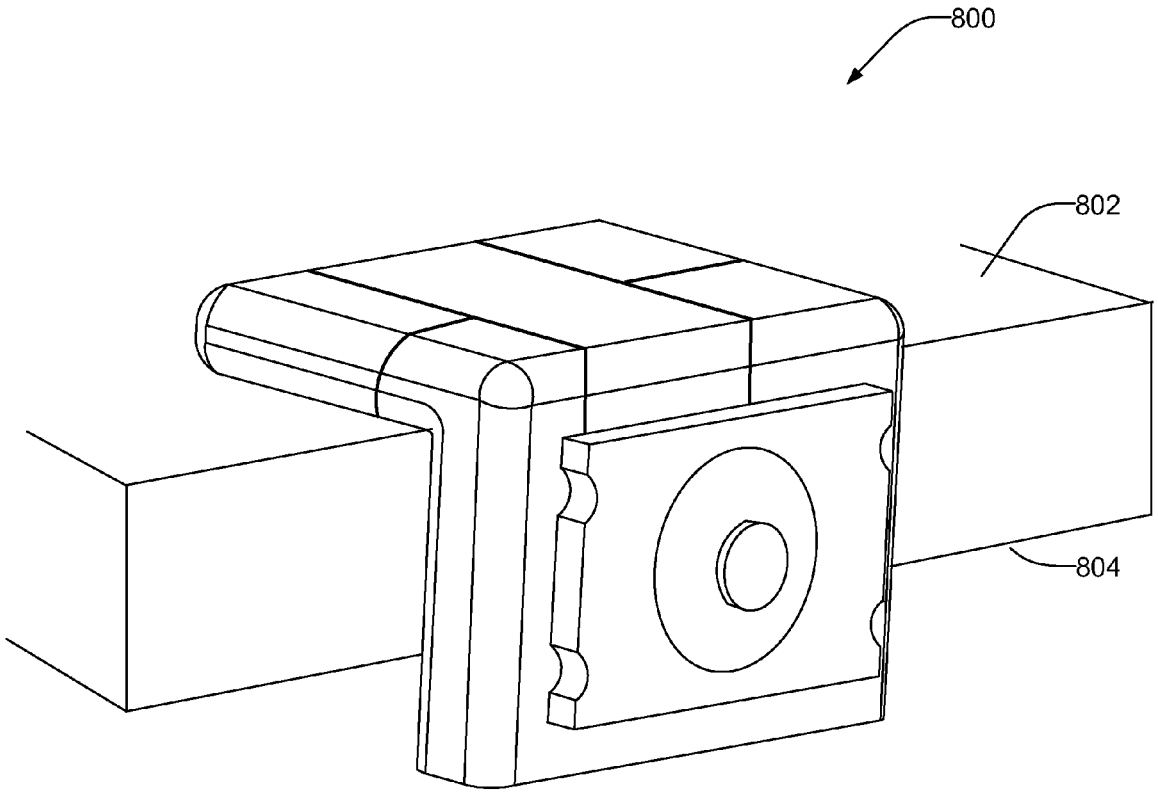
FIG. 8 illustrates another example keypad apparatus in accordance with the teachings disclosed herein mounted to a circuit board.

FIG. 8 illustrates another example electrical switch assembly 800 disclosed herein. The electrical switch assembly 800 of FIG. 8 is coupled to a first surface 802 of a circuit board 804. In this example, the electrical switch assembly 800 is mounted on the first surface 802 of the circuit board 804 via soldering. However, in other examples, the switch assembly 800 may be coupled to the circuit board 804 via any other suitable chemical fastener(s) (e.g., adhesive) and/or mechanical fastener(s).

Figure 9:
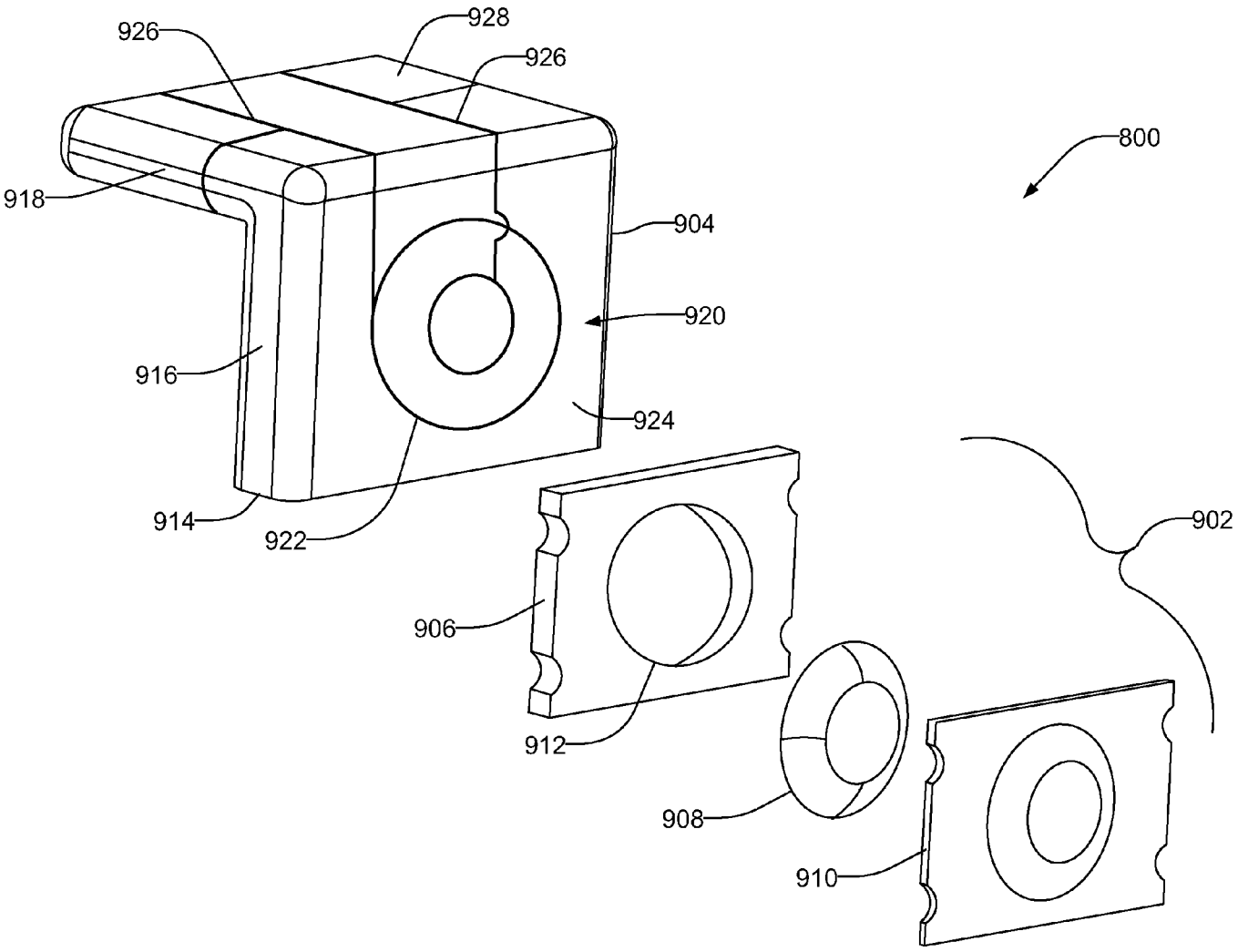
FIG. 9 is an exploded view of the example keypad apparatus of FIG. 8.

FIG. 9 is an exploded view of the example electrical switch assembly 800 of FIG. 8. The electrical switch assembly 800 employs a dome-switch assembly 902 coupled to a carrier 904 (e.g., via solder or an adhesive). The dome-switch assembly 902 includes a housing 906, a dome 908 and a dome-sheet 910. The housing 906 includes an opening 912 to receive the dome 908. The dome-sheet 910 is coupled to the housing 906 to retain the dome 908 in the opening 912 of the housing 906.

The carrier 904 of the illustrated example defines a body 914 having a first portion or leg 916 and a second portion or leg 918. More specifically, as shown, the body 914 defines an L-shaped body or profile such that the first portion 916 is substantially perpendicular relative to the second portion 918. In addition, the carrier 904 provides or defines a conductive trace pattern 920. More specifically, the conductive trace pattern 920 defines an electrical contact or conductive element 922 formed or provided on a first surface 924 (e.g., a side surface) of the first portion 916 that interact with the dome 908. The electrical contacts 922 are electrically coupled to the circuit board 804 via conductive traces 926. The conductive traces 926 extend from the first surface 924 of the first portion 916 across a second surface 928 of the second portion 918.

Figure 10:
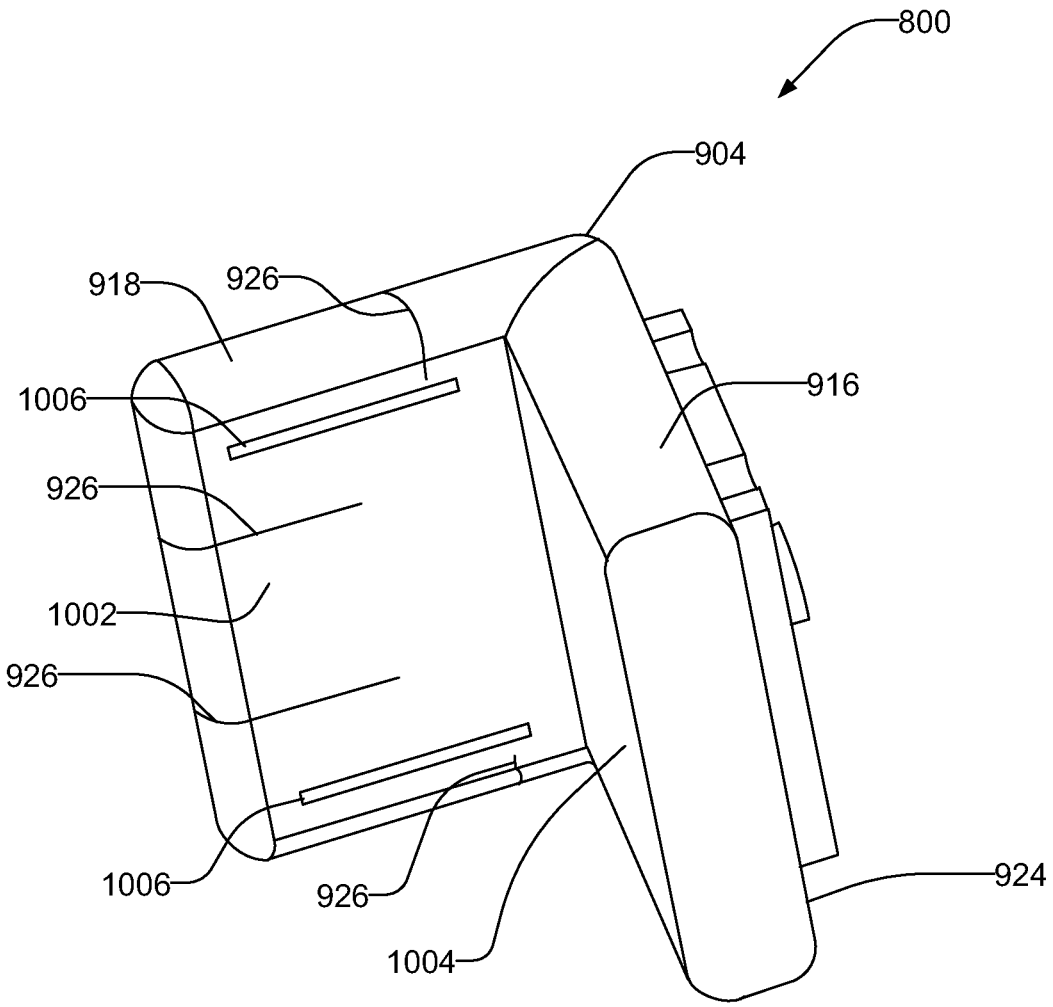
FIG. 10 is a perspective view of the example keypad apparatus of FIG. 8 and FIG. 9.

FIG. 10 is another perspective view of the example electrical switch 800 of FIGS. 8 and 9. Referring to FIGS. 8-10, the conductive traces 926 extend to a third surface 1002 of the second portion 918 of the carrier 904. The traces 926 formed on the third surface 1002 engage electrical contacts or traces positioned on the surface 802 of the circuit board 804, when the carrier 904 is coupled to the circuit board 804, to electrically couple the electrical contacts 922 and the circuit board 804. In other examples, the traces 926 may extend across any other surface(s) of the carrier 904. For example, the traces 926 may extend across the first surface 924 of the first portion 916 and a fourth surface 1004 of the first portion 916 to electrically engage electrical contacts on a side surface (e.g., perpendicular to surface 802) of the circuit board 804. Alternatively, the traces 926 can extend from the fourth surface 1004 of the first portion 916 to the third surface 1002 of the second portion 918. The carrier 904 may be coupled to the surface 802 of the circuit board 804 via, for example, solder 1006.

The carrier 904 of the illustrated example is a unitary structure or body. The carrier 904, for example, is composed of a plastic material or resin such as, for example, a Laser Direct Structuring (LDS) resin. The carrier 904 may be integrally formed via, for example, injection molding and/or any other suitable manufacturing process(es). In the illustrated example, after the carrier 904 is formed via an injection molding process, the electrical contacts 922 and/or the electrical traces 926 electrically coupling the electrical contacts 922 to the circuit board 804 may be formed or etched in the carrier 904 via, for example, the LDS manufacturing process described above.

Figure 11:
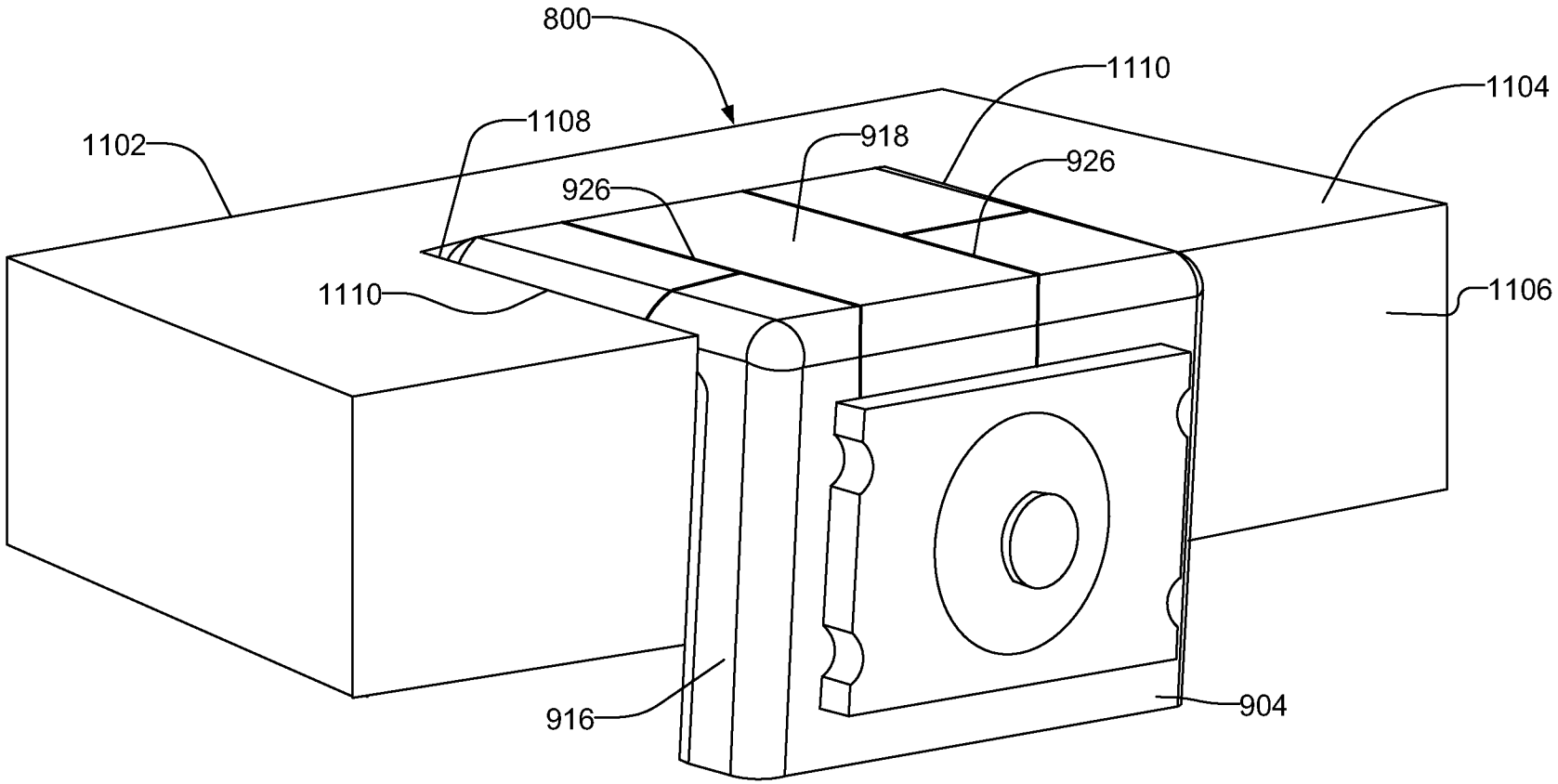
FIG. 11 illustrates the example keypad apparatus of FIGS. 8-10 flush mounted relative to a circuit board.

FIG. 11 illustrates the example switch assembly 800 of FIGS. 8-10 coupled to another example circuit board 1102. In this example, the circuit board 1102 enables the switch assembly 800 to be substantially flush-mounted relative to a surface 1104 of the circuit board 1102 (e.g., a surface substantially parallel to a display of an electronic device). In this example, the surface 1104 of the circuit board 1102 is substantially perpendicular to a side surface 1106 of the circuit board 1102. The circuit board 1102 includes a recess 1108 to receive a portion of the carrier 904. More specifically, the recess 1108 receives the second portion 918 of the carrier 904. The third surface 1002 (FIG. 10) of the carrier 904 engages a surface or base defined by the recess 1108 such that the traces 926 engage respective electrical contacts positioned on the base of the recess 1108. When coupled to the circuit board 1102, walls 1110 of the circuit board 1102 defined by the recess 1108 maintain or hold a portion and/or position (e.g., a lateral position) of the carrier 904 relative to the side surface 1106 of the circuit board 1102. Thus, the example electrical switch assembly 800 of FIG. 11 may be coupled to the circuit board 1102 without a mechanical fastener(s) (e.g., solder) or chemical fastener(s). The example switch assembly 800 and circuit board 1102 of FIG. 11 enables an electronic device (e.g., the electronic device 200) employing the electrical switch assembly 800 and the circuit board 1102 to have a relatively smaller profile or dimensional envelope compared to the switch assembly 800 mounted to the circuit board 804.

Figure 12:
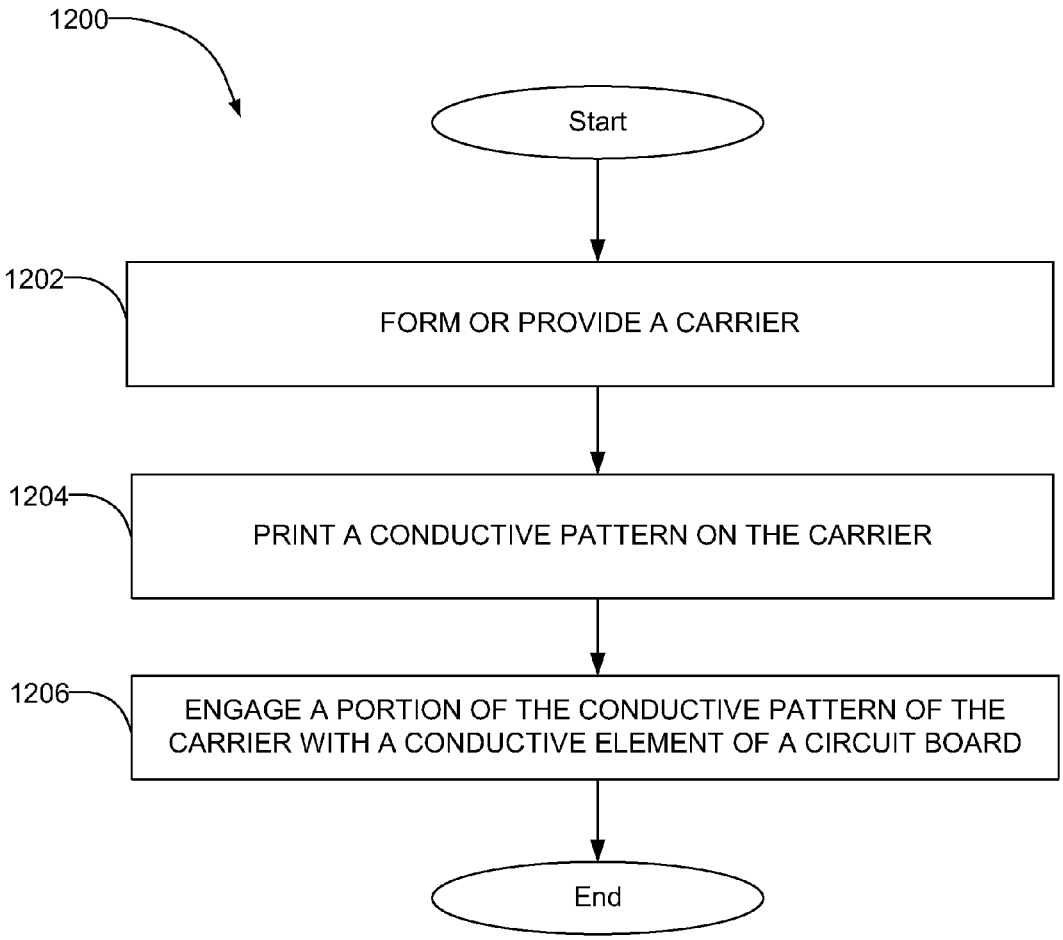
FIG. 12 is a flowchart of an example method that may be used to manufacture an example switch assembly disclosed herein.

FIG. 12 is a flowchart of an example method 1200 that may be used to manufacture an example switch assembly such as the example switch assemblies 300, 702 and 800 disclosed herein. While an example manner of manufacturing the example switch assembly, one or more of the blocks and/or processes illustrated in FIG. 12 may be combined, divided, re-arranged, omitted, eliminated and/or implemented in any other way. Further still, the example method of FIG. 12 may include one or more processes and/or blocks in addition to, or instead of, those illustrated in FIG. 12, and/or may include more than one of any or all of the illustrated processes and/or blocks. Further, although the example method 1200 is described with reference to the flow chart illustrated in FIG. 12, many other methods of manufacturing a covering assembly may alternatively be used.

To begin the example assembly process of FIG. 12, a carrier (e.g., the carrier 306) is formed or provided (block 1202). For example, the carrier may be composed of plastic and may be formed via injection molding. More specifically, the carrier may be formed via a resin (e.g., a thermoplastic material) capable of being used in a laser direct structuring process.

After the carrier is formed, a conductive pattern (e.g., the pattern 328) is printed or formed on one or more surfaces of the carrier (block 1204). For example, the carrier may include one or more conductive contacts or elements and one or more conductive traces or paths to electrically couple the conductive contacts to a circuit board. For example, the conductive pattern may be formed on any surface, wall or area of the carrier via the Laser Direct Structuring method. After the carrier is formed, an actuator or dome-switch assembly (e.g., the dome-switch assembly 304) is coupled to the carrier.

The carrier is then coupled to a printed circuit board (block 1206). More specifically, a portion of the conductive pattern is to engage a conductive element (e.g., the plated slots 406) of a circuit board. For example, a conductive contact may be formed on a first surface of the carrier and a conductive trace may extend from the first surface (e.g., a front surface) to a second surface (e.g., a rear surface) opposite the first surface to engage an electrical contact of a circuit board. In some examples, the carrier employs flexible fingers or arms (e.g., the flexible fingers 326) that engage plated slots or openings of the circuit board.

The example switch assemblies 300, 702 and 800 disclosed herein significantly facilitate assembly of a keypad apparatus to a circuit board. For example, the example electrical switch assemblies 300, 702 and 800 may be coupled to a circuit board via friction fit without the use of fasteners (e.g., chemical fasteners, mechanical fasteners, solder, etc.). In this manner, for example, the example switch assemblies 300, 702 and 800 disclosed herein reduce cost associated with soldering the switch assemblies 300, 702 and 800 to a circuit board. Additionally or alternatively, the example switch assemblies 300, 702 and 800 disclosed herein may be side mounted and/or flush mounted relative to a circuit board to reduce an overall dimensional profile (e.g., a height or width) of an electronic device.

The methods described herein may be carried out by software executed, for example, by the processor 102. Coding of software for carrying out such a method is within the scope of a person of ordinary skill in the art given the present description. A computer-readable medium having computer-readable code may be executed by at least one processor of the portable electronic device 100 to perform the methods described herein.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes that come within the meaning and range of equivalency of the claims are to be embraced within their scope.

What is claimed is:

1. A keypad apparatus comprising:

a dome-switch assembly having:

a housing;

a dome; and a dome sheet carrier to couple the dome to the housing;

a plastic carrier having at least a first surface, a second surface adjacent the first surface, a third surface adjacent the second surface, and a plurality of flexible arms, the dome-switch assembly being coupled to the first surface;

a conductive pattern printed on at least the first and second surfaces of the plastic carrier, the dome to engage a first portion of the conductive pattern formed on the first surface of the plastic carrier when the dome-switch is coupled to the plastic carrier, a second portion of the conductive pattern being printed on the plurality of flexible arms; and a circuit board having a main surface to be positioned substantially parallel relative to a display of an electronic device and a side surface of the circuit board substantially perpendicular relative to the main surface of the circuit board, the circuit board including one or more plated slots being exposed via the side surface, the second portion of the conductive pattern of the flexible arms to engage the plated slots to electrically couple the circuit board to the first portion of the conductive pattern.

2. The keypad apparatus of claim 1, wherein the plastic carrier comprises an L-shaped body, the first surface defining a first leg of the L-shaped body and the second surface defining a second leg of the L-shaped body.

3. The keypad apparatus of claim 2, wherein the circuit board includes a recess to receive the second leg of the L-shaped body such that a surface of the second leg of the L-shaped body is substantially flush mounted relative to the main surface of the circuit board.

4. The keypad apparatus of claim 1, wherein the plastic carrier is coupled to the main surface of the circuit board via solder.

5. The keypad apparatus of claim 1, wherein the dome-switch is coupled to the first surface of the plastic carrier via solder.

6. The keypad apparatus of claim 1, wherein the housing includes an opening to receive at least a portion of the dome.

7. A method of forming a keypad apparatus, comprising forming a carrier composed of plastic via injection molding, the carrier having a first flexible arm;

printing a first conductive trace on the carrier to define at least a portion of a first electrical switch;

printing a second conductive trace on the first flexible arm and electrically coupling the first conductive trace and the second conductive trace; and engaging a portion of the first flexible arm having the second conductive trace with a first slot formed in a side surface of a circuit board and plated with a conductive material to electrically couple the first conductive trace and the circuit board.

8. The method of claim 7, wherein printing the first and second conductive trances on the carrier comprises using a Laser Direct Structuring method.

9. The method of claim 7, further comprising forming a second flexible arm with the carrier adjacent the first flexible arm.

10. The method of claim 9, further comprising engaging the second flexible arm with a second slot formed in the side surface of the circuit board to cause the second flexible arm to impart a force to the circuit board to couple the carrier and the circuit board.

11. The method of claim 9, further comprising printing a third conductive trace on the carrier to define at least a portion of a second electrical switch, printing a fourth conductive trace on the second flexible arm, and electrically coupling the third conductive trace and the fourth conductive trace.

12. The method of claim 11, further comprising engaging the second flexible arm having the fourth conductive trace with a second slot of the circuit board plated with a conductive material to electrically couple the third conductive trace and the circuit board.

* * * * *